US005144968A

United States Patent [19]

Rivera

[11] Patent Number: 5,144,968

[45] Date of Patent: Sep. 8, 1992

[54] PERMANENT WAVE ROD

[76] Inventor: Ramon P. Rivera, 5123 El Roble Ct., San Jose, Calif. 95118

[21] Appl. No.: 759,486

[22] Filed: Sep. 13, 1991

[51] Int. Cl.[5] ..... A45D 2/20

[52] U.S. Cl. ..... 132/247; 132/253

[58] Field of Search ..... 132/245, 246, 247, 253, 132/254, 265, 273

[56] References Cited

U.S. PATENT DOCUMENTS

| | | | |
|---|---|---|---|
| 182,088 | 9/1876 | Walker . | |
| 476,824 | 6/1892 | Scelley . | |
| 731,816 | 3/1903 | Connell . | |
| 844,823 | 2/1907 | Martin . | |
| 1,346,920 | 7/1920 | Steinacher | 132/247 |
| 1,538,809 | 5/1925 | Henry | 132/247 |
| 2,061,817 | 11/1936 | Van Cleef . | |
| 2,105,371 | 1/1938 | Peddle . | |
| 2,507,356 | 5/1950 | Steiner et al. | 132/247 |
| 2,645,233 | 7/1953 | Bein, Sr. . | |
| 2,874,706 | 2/1959 | Ficicchy . | |
| 3,507,291 | 4/1970 | Gaxiola . | |
| 3,955,064 | 5/1976 | Demetrio et al. . | |
| 4,239,050 | 12/1980 | Leuzzi . | |
| 4,310,008 | 1/1982 | Lalli | 132/247 |
| 4,540,006 | 9/1985 | Collis . | |
| 4,572,221 | 2/1986 | Barradas . | |
| 4,648,414 | 3/1987 | Fox et al. . | |
| 4,834,118 | 5/1989 | Goeller | 132/246 |
| 4,844,103 | 7/1989 | Vick et al. . | |
| 5,025,816 | 6/1991 | Jones | 132/247 |
| 5,042,513 | 8/1991 | Ferguson | 132/247 |

FOREIGN PATENT DOCUMENTS

| | | | |
|---|---|---|---|
| 3713280 | 12/1987 | Fed. Rep. of Germany . | |
| 705559 | 6/1931 | France | 132/247 |
| 3089109 | 4/1988 | Japan | 132/246 |
| 68721 | 10/1951 | Netherlands | 132/247 |
| 74440 | 12/1948 | Norway . | |
| 62737 | 4/1927 | Sweden | 132/247 |
| 821813 | 10/1959 | United Kingdom . | |
| 2116032 | 9/1983 | United Kingdom | 132/246 |

*Primary Examiner*—Gene Mancene
*Assistant Examiner*—Frank A. LaViota
*Attorney, Agent, or Firm*—John J. Leavitt; William A. Blake

[57] ABSTRACT

Presented is a permanent wave rod formed from an elongated elastically flexible synthetic resinous body devoid of embedded bendable wire and symmetrical about its longitudinal axis and having push-to-engage and pull-to-disengage cooperable fastener elements associated with opposite ends whereby a tress of hair may be spirally wound on the elongated body and the opposite ends engaged to form the elongated body into an ovate configuration to retain the tress of hair on the rod body.

1 Claim, 2 Drawing Sheets

PERMANENT WAVE ROD

BACKGROUND OF THE INVENTION

1. Field of the Invention

This invention relates to devices for grooming the hair, such as in applying a permanent wave to human hair, and particularly to an exceptionally light weight permanent wave rod that does not impose unnatural tension on the hair.

2. Description of the Prior Art

A preliminary patentability and novelty search in connection with this invention has revealed the existence of the following six U.S. Patents:

| | | |
|---|---|---|
| 4,844,103 | 4,648,414 | 4,572,221 |
| 4,540,006 | 2,061,817 | 2,105,371 |

Other patents that are known to exist that relate to devices for grooming hair include the following U.S. Patents:

| | | |
|---|---|---|
| 182,088 | 476,824 | 731,861 |
| 844,823 | 2,645,233 | 2,874,706 |
| 3,507,291 | 3,955,064 | 4,239,050 |

Foreign patents known to exist include Norwegian Patent 74440; British Patent 821,813 and German Patent 3,713,280. The latter group of U.S. Patents and the foreign patents are believed to pertain primarily to devices for temporarily curling the hair as distinguished from devices applied for effecting a permanent wave to human hair.

In applying a permanent wave to human hair, there are many different procedures followed by hairdressers, and there are many different appliances and permanent wave solutions that are used to assist in providing to the human hair the type of permanent wave desired by the customer. Despite the improvements in appliances and solutions, hairdressing remains very much an art dependent upon the skill of the operator. A procedure that may generally be followed is described below, but it should be understood that the procedural description that follows is not inclusive of all procedures or methods used by various hairdressers, but are intended to be indicative only of general procedures or steps that may be followed by a hairdresser. Those steps include initially washing the hair, followed by towel drying the hair to remove excess water while still leaving the hair wet, after which segments of the wet hair in the form of tresses are separated from the main body of the hair, and tressend paper and permanent wave rods are applied to each tress until the full length of the tress is wound on the rod, this being generally coincident with the permanent wave rod abutting the scalp. By some appropriate means, the permanent wave rod and tress are locked together so that the hair tress does not unravel from the rod. This procedure is continued until all of the hair, frequently divided into as many as approximately 48–60 separate tresses, is wound on permanent wave rods. An appropriate permanent wave solution is then quickly applied to each individual tress that is now supported on a permanent wave rod, and the solution is permitted to remain on the curled hair for a finite time usually specified by the manufacturer of the solution, during which time heat may (or may not) be applied to the tresses that have been individually wrapped on the supporting permanent wave rods. It should be understood of course that the entire head of hair is segmented into separate tresses, each of which is individually wound on a separate permanent wave rod. After the permanent wave solution has acted on the hair for the interval of time specified by the manufacturer to effect setting of the curled hair on the permanent wave rod, the hairdresser may conduct a test by undoing one of the tresses and observing whether the tress falls in a smooth spiral, indicative of the degree to which the hair has been set by the permanent wave solution. It should be noted that modern permanent wave solutions are usually "timed" solutions, i.e., the solutions are "active" for a prescribed interval, after which the chemical activity ceases. Thus, present day modern permanent wave solutions obviate the need for a test as described above.

Following the prescribed time interval to properly set the hair, the permanent wave solution is then rinsed off and the head of hair, with the permanent wave rods still attached, is towel dried by patting the head gently to absorb as much of the moisture as possible. Then, a neutralizing solution is applied to the hair for approximately five minutes, after which the permanent wave rods are removed from the head of hair. The hair is then rinsed again with water for approximately five minutes to remove all vestiges of permanent wave solution or neutralizing solution that might have remained in the hair. Following the rinse, the hair is set or styled to suit the customer.

Referring to the patents listed in the first group noted above, it is noted that all of these patents utilize some type of elongated body about which the hair tress may be wrapped or spirally wound, with the exception of U.S. Pat. No. 2,105,371. The method taught by these patents to retain the straight permanent wave rod or curling rod in a hair-holding position, with the exception of U.S. Pat. No. 2,105,371, is a bendable wire rod embedded in the generally cylindrical permanent wave rod, so that when the ends of the cylindrical permanent wave rod are brought into close proximity, the embedded wire bends and in the absence of a force exerted on the bent rod to straighten it, it retains its bent position to thereby retain the curled hair on the permanent wave rod. U.S. Pat. No. 4,572,221 adds an embellishment to this construction in that the elongated permanent wave rod or curling rod is hollow and there is disposed therewithin an elongated coiled spring which prevents the hollow tube from collapsing when bent, and a cap is provided to retain the two ends in close proximity as illustrated in the drawings of that patent. Another one of the advantages touted by this patent is the fact that the cylindrical rod may be heated by dropping the open end over a heating post.

One of the disadvantages of these structures that include a bendable metallic element within the permanent wave rod is that upon repeated use, work hardening of the metal rod occurs, and eventually the metallic bendable rod breaks, thus destroying the usefulness of the permanent wave or curling rod. Accordingly, one of the important objects of the present invention is the provision of an extremely light weight permanent wave rod that is devoid of any type of embedded metallic and bendable rod, yet incorporates means for retaining opposed ends engaged in close proximity and selectively disengageable.

Another disadvantage of permanent wave rods that include bendable metallic elements as cores thereof is the likelihood of permanent wave or other hair care solutions penetrating the outer cylindrical member, which is frequently a sponge rubber or synthetic resinous material, thus causing corrosion to develop on the metallic rod. Accordingly, another object of the present invention is the provision of a permanent wave rod that is fabricated from materials that are extremely light and which are impenetrable by permanent wave solutions and other hair care products, and have nothing embedded within them.

In more modern times, such as the present, permanent wave rods have been formed from elongated plastic tubes, either hollow or solid, as illustrated in FIGS. 1A through 2B, with means associated with opposite ends to retain the opposite ends in close proximity or in virtual engagement one with the other when so desired. One of the disadvantages that has been experienced with such rods is that they are heavy, and they are extremely slippery when coated with solutions of the type that are generally used for a permanent wave solutions or for curling the hair. The weight factor is an important factor because when applied to a tress of hair and the ends of the plastic tube or rod are brought together and locked, the weight of the rod imposes tension on the hair and creates an uncomfortable feeling in the scalp of the customer.

Referring to FIGS. 1A and 1B, such a prior art permanent wave rod that is approximately 12 inches long weighs a full one-half ounce. Since it is not unusual to apply as many as forty-eight to sixty to a full head of hair, it will be understood that just the cumulative weight of the rods themselves, apart from the permanent wave solution that is applied to them after the hair has been curled on the rods, amounts to approximately 24–30 ounces or 1.5 to 1.875 pounds of weight that is suspended on the hair and head.

With respect to the prior art permanent wave rod illustrated in FIGS. 2A and 2B, such a rod having a length of approximately nine and one-half inches, weighs a full ounce, thus resulting in a cumulative weight of forty-eight to sixty ounces or approximately 3.0 to 3.75 pounds. The suspension of so much weight on the hair is uncomfortable to the customer, and also imposes unwanted tension on the scalp and on the hair itself. Accordingly, a still further object of the invention is the provision of a permanent wave rod that is so light in weight that a set of forty-eight weighs only about 3 ounces.

The weight of prior art permanent wave rods such as illustrated in FIGS. 1A through 2B also creates the problem of orientation of the permanent wave rods after the ends have been joined. Because of the weight of the rods, gravity pulls the rods downwardly, thus causing the closed permanent wave rods to hang pendulum-like and to impose tension on the hair and scalp.

Another characteristic that has been noted of the heavy prior art rods shown is that even if it is desired to retain a tress of hair curled about a vertical axis, for instance, the weight of the prior art permanent wave rods, such as those illustrated in FIGS. 1A through 2B, impose so much weight on the curled tress of hair that the axis of rotation of the curled hair automatically shifts to a horizontal or near horizontal attitude by virtue of the slipperiousness of the solution-coated rod and the tension imposed on the hair by the weight of the permanent wave rod. This effects the way in which the curled tress will lie when the permanent wave rod is removed, thus reducing the amount of control that the hairdresser has on the hair and, consequently, on the ultimate appearance achieved. Accordingly, another object of the present invention is the provision of a permanent wave rod so light in weight that the hair tresses may be curled about an axis extending in any selected direction with the full expectation that the axis of the hair curl will remain extending in the direction in which it is set by the hairdresser, thus providing greater control in the appearance of the hair when the permanent wave rods are removed by the hairdresser.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the permanent wave rod of the invention comprises a selected length of closed cell synthetic resinous material of any selected length, such as six inches, nine inches, or twelve inches, or even a specialized length for specialized purposes when dressing a head of hair. The permanent wave rod is elongated, symmetrical about a longitudinal axis and is provided with a closed cell surface or "skin" so that permanent wave solutions or other types of hair care solutions cannot penetrate the body of the permanent wave rod. Yet, because of its elastic flexibility and elastic compressibility, the rod is not slippery when in use, even when coated with permanent wave solution. For small heads of hair, or for relatively tight permanent waves, a permanent wave rod of approximately one-half inch diameter and six inches long has been found to be adequate. For a more bountiful head of permanently waved hair, a larger diameter, for instance one inch, and longer permanent wave rods may be utilized. Each permanent wave rod is cut off at a 90° angle, and circumscribing one end portion there is adhesively secured a band of pressure sensitive fabric that may be felt-like material adapted to be engaged by hook-type fastener elements secured to the opposite end of the rod when the two ends are brought into engagement, or which may be complementary hook-type material which when pressed together releasably interengage and which may be pulled apart by applying tension. The type of pressure sensitive fabric preferred is the type that is frequently sold under the trademark VELCRO and comprises a felt-like material forming the band around one end portion of the rod, and hook-like elements projecting from a layer of synthetic resinous material that is adhesively secured to the opposite end of the permanent wave rod.

DESCRIPTION OF THE PREFERRED EMBODIMENT

Figure 1A:
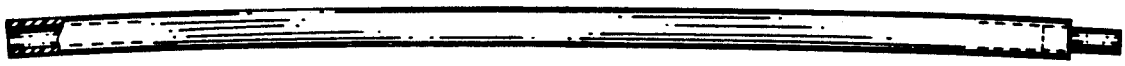
FIG 1A (PRIOR ART)
FIG. 1A illustrates a permanent wave rod of a prior art type shown in its extended or free form.
Figure 1B:
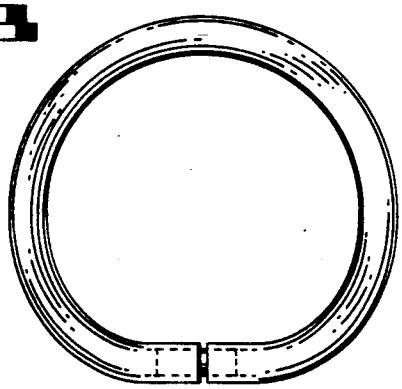
FIG 1B (PRIOR ART)
FIG. 1B is a plan view of the permanent wave rod of FIG. 1A with the ends engaged to form a near circle of the permanent wave rod.
Figure 2A:
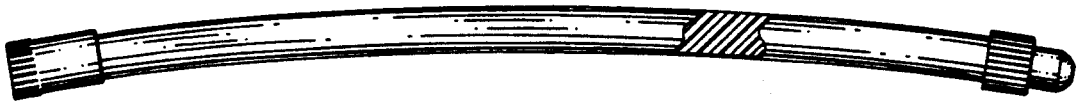
FIG 2A (PRIOR ART)
FIG. 2A is another type of prior art permanent wave rod that utilizes a solid plastic rod with attachment means on opposite ends, enabling the elongated rod to be bent into a near circle when the ends are attached.
Figure 2B:
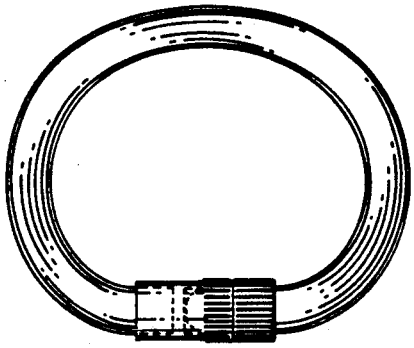
FIG 2B (PRIOR ART)
FIG. 2B is a plan view of the permanent wave rod illustrated in FIG. 2A that has been formed into a near circle and the ends attached.
Figure 3A:
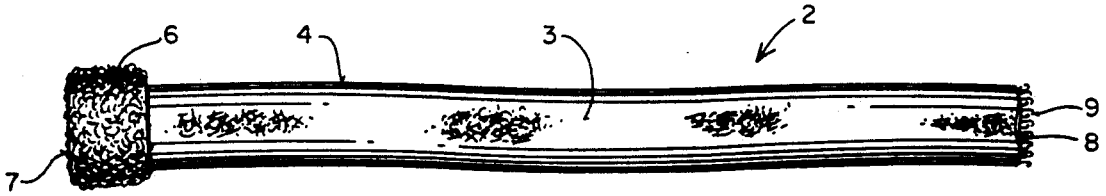
FIG. 3A is a plan view of the permanent wave rod forming the subject matter of this invention shown in its extended or free form.

In terms of greater detail, and referring to FIG. 3A, it is seen that the permanent wave rod of this invention is designated generally by the numeral 2 and comprises an elongated body 3 formed from a synthetic resinous material of the closed cell-type and having a surface 4 that is impervious to moisture, i.e., moisture will not penetrate the surface 4, so that permanent wave solutions or other types of hair care products in liquid form cannot penetrate the surface 4. At one end, the rod is provided with a felt-like band 6 encircling an end portion of the rod 3, the band 6 as illustrated in FIG. 3A having a width of approximately one-half inch, with one edge of the band being flush with the end 7 of the rod body 3. The band 6 is adhesively secured permanently about the permanent wave rod.

Figure 3B:
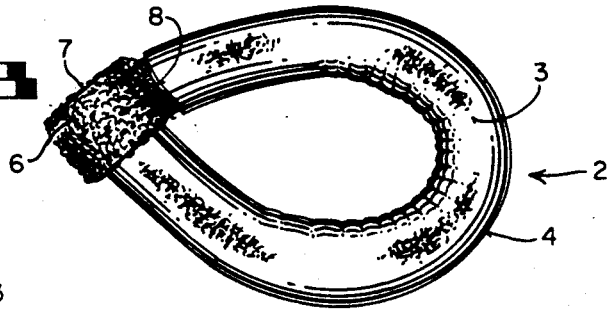
FIG. 3B is a plan view of the permanent wave rod of this invention shown with the ends detachably secured.
Figure 4:
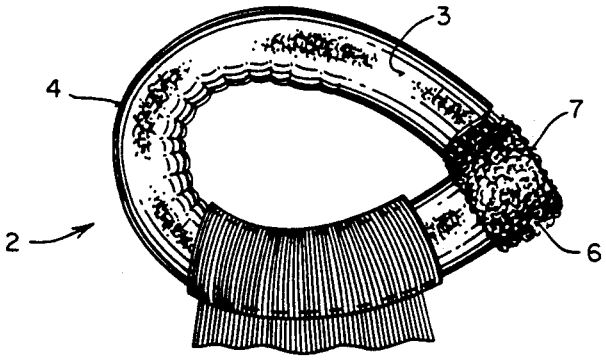
FIG. 4 is a plan view similar to FIG. 3B but showing the manner in which a tress of hair may be wound on the permanent wave rod while still in its straight and extended form as illustrated in FIG. 3A, and then the ends of the rod brought into engagement to lock the curl and rod to the head.

At the opposite end of the rod body 3, the end 8 of the rod body 3 is perpendicular to the longitudinal axis of the rod, and is provided with a layer of hook material 9 that is adhesively secured permanently to the end of the rod in the same manner that the band 6 is adhesively secured to the opposite end portion of the rod body 3. In this manner, when the rod body 3 is manipulated to bring the hook elements 9 into engagement with the felt-like band 6, as illustrated in FIGS. 3B and 4, it will be seen that the rod body is formed into a generally teardrop configuration rather than a near circle as with the prior art devices illustrated in FIGS. 1A through 2B. In particular, it should be noted that the end portions of the rod body 3 remain substantially unstressed in the engaged position illustrated in FIG. 3B. This is important because whatever residual resilience is possessed by the rod body works over an elongated arm and the residual force tending to prematurely disengage the engaged ends of the rod body diminishes toward the end portions of the rod. In this respect, this effect is achieved by virtue of the fact that the band 6 of felt-like material in the preferred embodiment is wrapped about the outer periphery of the end portion of the rod body, rather than being adhered to the extreme end 7 of the rod body. It will thus be seen that if the felt-like pad or band 6 were mounted on the extreme end 7 of the rod, the two opposing ends would have to be brought into substantial axial alignment for engagement of the ends to occur, and such axial alignment would necessitate a very sharp bend to be made in the end portions of the rod body adjacent each of the ends 7 and 8. In such a case, the inherent resilience of the rod body, even though it is formed from an extremely light foam-like material, would exert a separating force on the hook and felt engagement and tend to effect disengagement of the engaged ends.

Depending upon the skill of the hairdresser and the preferences of the customer, the permanent wave rod as illustrated in FIG. 3A may be manipulated so that a tress of hair having a length of permanent wave paper applied to the free end thereof, may be wound spirally on the permanent wave rod body 3 so that hair is not wound on hair. When the full length of the hair tress has been so wound on the permanent wave rod, the hook ends 9 are brought into contact with the felt-like band 6, and the permanent wave rod may then be released and it will remain in the position in which it is in when the winding of the hair tress has been completed. Alternatively, as illustrated in FIG. 4, again depending upon the skill of the hairdresser and the preferences of the customer, the hair tress may be wound spirally hair on hair so that each succeeding spiral wound on the permanent wave rod is of some larger diameter than the underlying spiral, the ends of the permanent wave rod body 3 again being brought into engagment.

Figure 5:
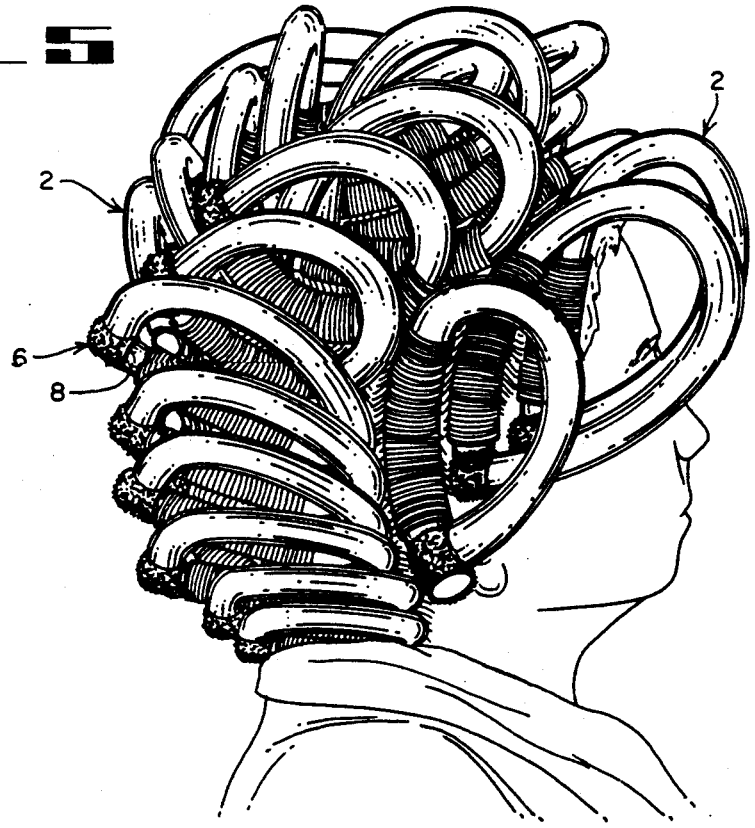
FIG. 5 is a perspective view illustrating a head of hair on which a multiplicity of tresses have been wound on the permanent wave rod of this invention for support during the application of permanent wave solution.

After the entire head of hair has been wound on the requisite number of permanent wave rods as illustrated in FIG. 5, the remaining steps of the permanent wave procedure as outlined above are followed, and ultimately, after sufficient setting of the hair to effect the degree of curl desired by the customer, the rods are removed and the hair set or styled according to the preferences and the skill of the hairdresser.

Having thus described the invention, what is believed to be new and novel and sought to be protected by letters patent of the United States is as follows.

I claim:

1. A permanent wave rod, comprising:

a) an elongated, elastically flexible, cylindrical body entirely of closed-cell synthetic resinous material having a moisture impervious, curvilinear side surface and first and second end surfaces perpendicular to said side surface; and b) mutually engagable connector means for connecting said first end surface to said side surface adjacent said second end surface to form said flexible body into a generally ovate configuration, said mutually engagable connector means including a first connector part disposed on said first end surface and a second, mating connector part attached to said side surface adjacent said second end surface;

said first connector part comprising a layer of hook material adhesively secured to said first end surface and said second connector part comprising a cylindrical band of loop material peripherally and adhesively secured to said side surface adjacent said second end surface.

* * * * *